US007753812B2

(12) United States Patent
Lucas et al.

(10) Patent No.: US 7,753,812 B2
(45) Date of Patent: Jul. 13, 2010

(54) HEAD RETAINING MECHANISM FOR A LACROSSE STICK

(76) Inventors: Michael E. Lucas, 360 Dart La., Fenton, MO (US) 63026-2811; Anthony M. Abram, 360 Dart La., Fenton, MO (US) 63026-2811

( * ) Notice: Subject to any disclaimer, the term of this patent is extended or adjusted under 35 U.S.C. 154(b) by 577 days.

(21) Appl. No.: 11/562,215

(22) Filed: Nov. 21, 2006

(65) Prior Publication Data

US 2007/0117661 A1 May 24, 2007

Related U.S. Application Data

(60) Provisional application No. 60/738,623, filed on Nov. 21, 2005.

(51) Int. Cl.
*A63B 59/02* (2006.01)
*A63B 65/12* (2006.01)

(52) U.S. Cl. ..... 473/513; D21/724

(58) Field of Classification Search ..... 473/505, 473/513, 512, 533; 248/161; 74/551.9; D21/724; 411/57.1, 60.1
See application file for complete search history.

(56) References Cited

U.S. PATENT DOCUMENTS

| | | | | | |
|---|---|---|---|---|---|
| 626,633 | A | * | 6/1899 | Robinson | 74/551.9 |
| 1,580,724 | A | * | 4/1926 | Harmon | 74/551.9 |
| 1,932,902 | A | | 9/1931 | McDowell | |
| 2,619,525 | A | | 4/1950 | Callaghan, Sr. | |
| 2,947,556 | A | * | 8/1960 | Wenger | 403/290 |
| 3,004,743 | A | * | 10/1961 | Wenger | 248/161 |
| 3,507,495 | A | | 4/1970 | Tucker et al. | |
| 3,833,218 | A | | 9/1974 | Frenkel et al. | |
| 3,918,323 | A | * | 11/1975 | Prager | 74/551.8 |
| 4,077,627 | A | | 3/1978 | Cheatham et al. | |
| 4,671,511 | A | * | 6/1987 | Trysinsky | 473/552 |
| 4,940,243 | A | | 7/1990 | Tucker et al. | |
| 5,566,947 | A | | 10/1996 | Tucker et al. | |
| 5,685,791 | A | | 11/1997 | Feeney | |
| 6,030,302 | A | * | 2/2000 | Chojnacki | 473/531 |
| 6,168,534 | B1 | | 1/2001 | Schultz | |
| 6,202,663 | B1 | * | 3/2001 | Uemura | 135/65 |
| 6,862,776 | B2 | * | 3/2005 | Chen | 16/113.1 |
| 6,964,214 | B2 | * | 11/2005 | Wu | 74/551.8 |

(Continued)

OTHER PUBLICATIONS

"Harrow Sports :: Frequently Asked Questions," Harrow Sports, Inc., http://harrowsports.com/help/faq.asp, printed on Nov. 25, 2009, 1 page.

(Continued)

*Primary Examiner*—Gene Kim
*Assistant Examiner*—M Chambers
(74) *Attorney, Agent, or Firm*—Lewis, Rice & Fingersh, L.C.

(57) ABSTRACT

A mechanism for securing a handle to a head, particularly of a lacrosse stick, comprises a shaft having a wedge portion positioned at a distal end thereof, a binding plate positioned adjacent to said shaft, and a means for moving said wedge portion in a longitudinal direction relative to said binding plate. Longitudinal movement of said wedge portion causes latitudinal movement of said binding plate, thereby binding said handle to said head. Such a mechanism can be used in a method for securing and maintaining secure the joint between a handle and a head, either in a new lacrosse stick or as a retrofit.

9 Claims, 3 Drawing Sheets

U.S. PATENT DOCUMENTS

| | | | | |
|---|---|---|---|---|
| 2002/0022533 | A1 | 2/2002 | Churovich et al. | |
| 2004/0063522 | A1 | 4/2004 | Wolf | |
| 2005/0075200 | A1 | 4/2005 | Brine, III et al. | |
| 2005/0282667 | A1 * | 12/2005 | Morrow | 473/513 |
| 2008/0146386 | A1 | 6/2008 | Morrow | |

OTHER PUBLICATIONS

"How to screw into Reebok Carbon Fiber Shaft—Lacrosse Forum," Lacrosse Forum, http://www.lacrosseforum.com/lacrosse-equipment/2972-how-screw..., printed on Nov. 25, 2009, 3 pages.

* cited by examiner

HEAD RETAINING MECHANISM FOR A LACROSSE STICK

CROSS REFERENCE TO RELATED APPLICATIONS

This application claims priority to and the benefit of U.S. Provisional Patent Application No. 60/738,623, filed Nov. 21, 2005, which is incorporated herein in its entirety by this reference.

BACKGROUND OF THE INVENTION

1. Field of the Invention

This invention relates to a mechanism for connecting the head of a lacrosse stick or other racket, club, or two-piece implement to a handle therefore. In particular, the mechanism generally provides for a pressure to be applied from inside a hollow handle to press together portions of the handle and the head.

2. Description of Related Art

In playing the sport of lacrosse, players use a lacrosse stick to catch a ball, cradle and control the ball, and pass the ball to another player or shoot the ball into a goal. The lacrosse stick typically comprises two portions: a head portion and a handle portion. The head is typically constructed to receive the ball and release the ball from a pocket or basket area while the handle is typically relatively long and narrow and constructed to allow the player to impart momentum to the ball by using upper body strength. Traditional lacrosse sticks are substantially rigid in that they do not flex during use.

While some sticks have a one-piece design in which the head and stick handle are jointly formed from a single piece of wood, metal or plastic, more often today, sticks have a two-piece design in which the head and handle are independently fabricated and subsequently joined together in a rigid fashion. Sticks having a two-piece design typically include a socket element in the head portion for insertion and rigid attachment of the handle. The head of a lacrosse stick is typically attached to the stick in a generally longitudinally coaxial orientation.

Stick handles are typically made of straight-grained wood, wood laminate or a tough, lightweight metallic or reinforced plastic tubular material. Thin gauge metallic extrusion, such as aluminum, or tough polymeric materials, such as fiber reinforced composite plastics, are typically the most suitable materials for lacrosse stick handles. Head frames are typically formed from a tough synthetic thermoplastic material, such as high impact strength nylon. Typically, the head flame and stick handle are fastened together at the socket joint by a fastener, such as a screw, a pin, a rod, or another fastener, which typically extends through the head at the socket and into the handle, rigidly joining these pieces together.

Since there are extensive forces exerted through the lacrosse stick during play, the joint between the head and the handle receives significant strain, which in the traditional joint, can cause damage to the fastener or to the hole in the head or handle of the lacrosse stick. Even without direct damage to the joint, these forces may cause a loosening of the fastener that otherwise rigidly holds together the handle and the head. Further, because players desire to exert force through the stick they often desire a particularly rigid joint between the handle and the head, leading to excessive tightening of the fastener, and potentially to the stripping of the threads of the fastener or the hole into which the fastener is put. Damage to the joint, the fastener or the hole may result in the user being unable to sufficiently secure the head to the handle, making that combination of head and handle unplayable. Moreover, such damage may make removal of the fastener or disconnection of the head from the handle difficult. Not only is this a problem for the user during play, but also is a cost burden for the player who must replace or repair a damaged head, handle or fastener.

SUMMARY OF THE INVENTION

The following is a summary of the invention in order to provide a basic understanding of some aspects of the invention. This summary is not intended to identify key/critical elements of the invention or to delineate the scope of the invention. Its sole purpose is to present some concepts of the invention in a simplified form as a prelude to the more detailed description that is presented later. An embodiment is an assembly that can be inserted into a hollow handle of a lacrosse stick for use as a retention mechanism for securely attaching a lacrosse stick head to the handle. In an embodiment, the assembly comprises a shaft having a proximal end and a distal end and a length therebetween; a binding plate positioned adjacent to the shaft; a wedge portion positioned at the distal end of the shaft, the wedge portion being moveable relative to the binding plate in a longitudinal direction; and a means for moving the wedge portion longitudinally relative to the binding plate; wherein when the assembly is constrained within a hollow handle, sufficient longitudinal movement of the wedge portion relative to the binding plate in a longitudinal direction toward the proximal end of the shaft causes the binding plate to move relative to the shaft in an latitudinal direction generally perpendicular to the longitudinal direction.

More specifically, in an embodiment of such an assembly, the shaft and the wedge portion are fabricated as one piece, the wedge portion being an integral part of the distal end of the shaft. In another embodiment, the binding plate is formed as an expansion sleeve and the shaft is positioned through the expansion sleeve. In an embodiment having an expansion sleeve, the assembly further comprises a retention sleeve having the shaft positioned therethrough, the retention sleeve being positioned towards the proximal end of the shaft relative to the expansion sleeve. In an alternate embodiment, an assembly as first described above further comprises a washer through which passes the proximal end of the shaft, the washer sized to provide a surface on which rests the binding plate.

In an embodiment of such an assembly, the means for moving comprises threads cut into a portion of the shaft. Such an embodiment alternately further comprises a complementarily threaded element; wherein the threads of the shaft are provided on the proximal end of the shaft and are engaged by the complementarily threaded element, such that rotation of the complementarily threaded element in a first direction moves the shaft in a longitudinal direction relative to the complementarily threaded element toward the complementarily threaded element. Still alternately, the distal end of the shaft is provided with threads, and the wedge portion is threaded onto the distal end.

An embodiment is a lacrosse stick that comprises a hollow handle having a proximal end and a distal end; a head with an extension that forms a joint with the distal end of the handle; and a retention mechanism that is separable from both the handle and the head, that is positioned generally within the hollow handle. In an embodiment, the retention mechanism comprises a shaft having a proximal end and a distal end and a length therebetween; a binding plate positioned adjacent to the shaft; a wedge portion positioned at the distal end of the shaft, the wedge portion being moveable relative to the binding plate in a longitudinal direction; and a means for moving the wedge portion longitudinally relative to the binding plate. In an embodiment of such a lacrosse stick, sufficient longitudinal movement of the wedge portion relative to the binding plate in a longitudinal direction toward the proximal end of the shaft causes the binding plate to move relative to the shaft in an latitudinal direction generally perpendicular to the longitudinal direction, and thereby bind the handle to the head.

More specifically, in an embodiment of such a lacrosse stick, the shaft and the wedge portion are fabricated as one piece, the wedge portion being an integral part of the distal end of the shaft. In another embodiment, the binding plate is formed as an expansion sleeve and the shaft is positioned through the expansion sleeve. In an embodiment having an expansion sleeve, the assembly further comprises a retention sleeve having the shaft positioned therethrough, the retention sleeve being positioned towards the proximal end of the shaft relative to the expansion sleeve. In an alternate embodiment, an assembly as first described above further comprises a washer through which passes the proximal end of the shaft, the washer sized to provide a surface on which rests the binding plate.

In an embodiment of such a lacrosse stick, the means for moving comprises threads cut into a portion of the shaft. Such an embodiment alternately further comprises a complementarily threaded element; wherein the threads of the shaft are provided on the proximal end of the shaft and are engaged by the complementarily threaded element, such that rotation of the complementarily threaded element in a first direction moves the shaft in a longitudinal direction relative to the complementarily threaded element toward the complementarily threaded element. Still alternately, the distal end of the shaft is provided with threads, and the wedge portion is threaded onto the distal end.

A still further embodiment is a method of fastening a handle to a head of a lacrosse stick. In an embodiment, the method comprises connecting a hollow handle to a head at a joint at a distal end of the handle; providing a retention mechanism as described above; inserting the retention mechanism into the hollow handle such that the wedge portion is positioned within the joint between the head and the handle; and moving the wedge portion longitudinally toward the proximal end of the handle, thereby causing the binding plate to move latitudinally, binding the handle to the head. As described above, in an embodiment, the retention mechanism comprises a shaft having a proximal end and a distal end and a length therebetween; a binding plate positioned adjacent to the shaft; a wedge portion positioned at the distal end of the shaft, the wedge portion being moveable relative to the binding plate in a longitudinal direction; a means for moving the wedge portion longitudinally relative to the binding plate.

DETAILED DESCRIPTION OF PREFERRED EMBODIMENTS hi light of the above description of traditional lacrosse stick construction, the present invention provides an alternate mechanism for maintaining the head securely in place on the handle, and avoiding problems associated with the holes and fasteners of the prior art. An embodiment of the present invention allows the connection of the head to the handle to be easily tightened, even during play, in the event that the joint becomes wobbly. Further, an embodiment allows easy removal and exchange of the head or handle portion of the stick.

Figure 1:
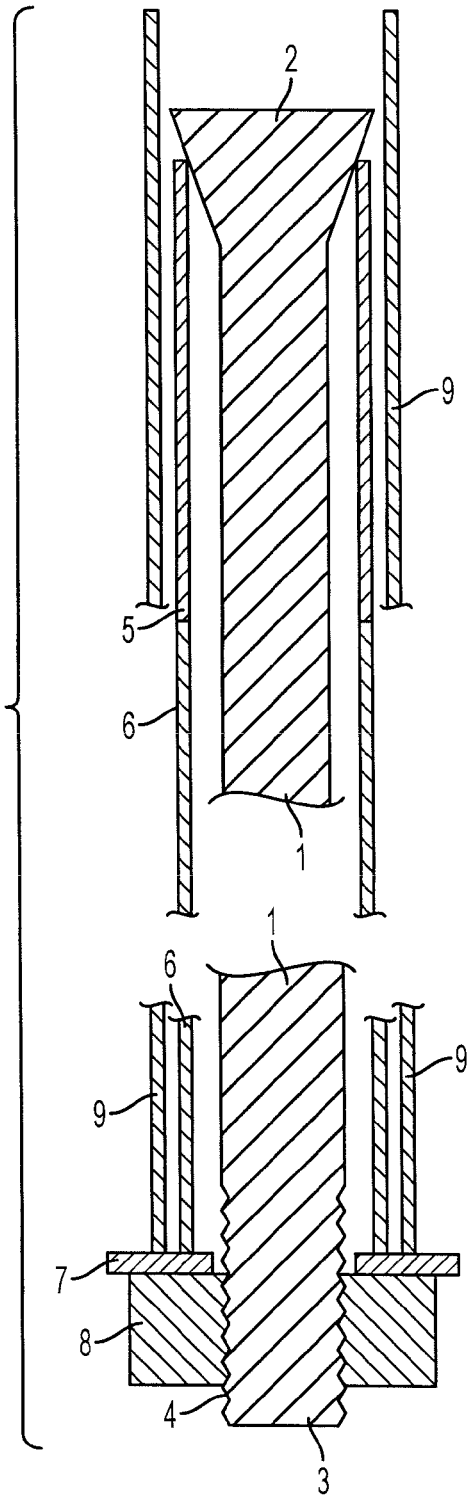
FIG. 1 shows a cross-sectional view of an embodiment of a retaining mechanism positioned within a lacrosse stick handle.

As shown in FIG. 1 an embodiment of the invention comprises a generally cylindrical central shaft 1 having a generally conically expanding distal end 2 and a proximal end 3 having threads 4. While shown as a single solid shaft, the central shaft 1 could also be hollow and could be made of more than one piece. The shaft 1 is positioned through both of an expansion sleeve 5 and a retention sleeve 6. The two sleeves 5 and 6 are generally shaped as hollow cylinders having an inner diameter larger than that of the shaft 1 but smaller than the largest diameter of the expanding distal end 2 of the shaft 1. The combined length of the two sleeves 5 and 6 is somewhat less than the total length of the shaft 1. Thus, when the shaft 1 is positioned through each of the two sleeves 5 and 6 and the two sleeves are positioned immediately adjacent to and touching one another along the direction of their longitudinal cylindrical axis, as shown in FIG. 1, both of the expanding distal end 2 and the threaded proximal end 3 of the shaft 1 protrude from opposite ends of the sleeves.

Further elements of the embodiment shown in FIG. 1 include a washer 7 and a nut 8. With respect to the shaft 1, the nut 8 is a complementarily threaded element, i.e., its threads engage the threads of the shaft 1. The nut 8 is threaded onto the threaded proximal end 3 of the shaft 1 with the washer 7 positioned between the nut 8 and the retention sleeve 6 in a manner such that the shaft 1 runs through a central hole in the washer 7, all as shown in FIG. 1. This assembly, including the shaft 1, two longitudinally aligned and adjacent sleeves 5 and 6, washer 7, and nut 8 is positioned generally within a hollow lacrosse stick handle 9 such that a proximal end of the handle 9 rests against the washer 7, and the an opposite distal end of the handle 9 extends beyond the expanding distal end 2 of the shaft 1.

Figure 2:
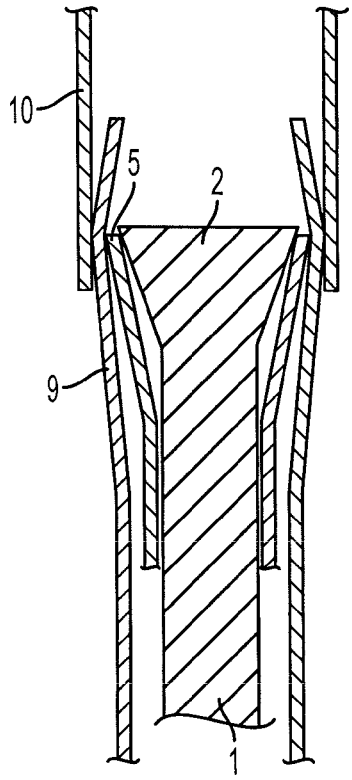
FIG. 2 shows a cross-sectional view of the embodiment of FIG. 1 positioned within a lacrosse stick handle, the expansion sleeve having been latitudinally expanded to contact the handle.

FIG. 2 depicts the embodiment also shown in FIG. 1, except that in FIG. 2 the head 10 is also shown. In the illustration of FIG. 2, the shaft 1 has been pulled into the expansion sleeve 5 (as by operation of the nut 8 shown in FIG. 1, such operation described below), forcing a latitudinal expansion of the expansion sleeve 5 and the handle 9, due to the wedge portion of the expanding distal end 2 of the shaft 1. FIG. 2 shows how the latitudinal expansion of the handle 9 puts pressure on the interior wall of the socket of a lacrosse stick head 10, thereby causing the head 10 to be held in place on the end of the handle 9.

In an alternate embodiment, the head 10 and the handle 9 are designed such that a portion of the head 10 extends internally within the handle instead of extending externally about the handle 9. In such an embodiment, the expansion sleeve 5 is positioned internal to the head, such that latitudinal expansion of the expansion sleeve 5 puts pressure on the head, which in turn puts pressure on the handle 9, to secure the head 10 to the handle 9. Whether the head 10 is positioned external or internal to the handle 9, the joint between the head 10 and handle 9 includes a hollow space wherein can be positioned the wedge portion and expansion sleeve 5 of the retention mechanism, as is shown in FIG. 2, for example.

A comparison between FIG. 1 and FIG. 2 is instructive in understanding the operation of this embodiment of the retaining mechanism. Rotation of the nut 8 in a first direction moves the shaft 1 relative to the nut 8 in a longitudinal direction due to the interaction of the threads on the nut 8 and the shaft 1. The rigid structure of the sleeves 5 and 6, and the washer 7, and nut 8, along with the direct serial contact among these elements, as illustrated in FIG. 1, provides that when the shaft 1 moves relative to the nut 8, the shaft 1 also moves relative to each of the sleeves 5 and 6 and the washer 7. Because of the arrangement of these elements, as the nut 8 is turned in a first direction, the shaft 1 is moved in a longitudinal direction toward the nut 8. As stated above, because of the connection between the nut 8, the washer 7, and the sleeves 5 and 6, the shaft 1 moves relative to each of these components. Further, due to the increasing latitudinal width of the expanding distal end 2 of the shaft 1, as the shaft 1 moves in a longitudinal direction relative to the sleeves 5 and 6, the expansion sleeve 5 is forced to expand latitudinally as the expanding distal end 2 is pulled into the expansion sleeve 5.

As shown in FIG. 2, latitudinal expansion of the expansion sleeve 5 has forced latitudinal expansion of the handle 9, thereby creating or increasing the latitudinal pressure exerted between the handle 9 and the head 10. Note that the latitudinal expansion is not necessarily shown to scale in FIG. 2, but is shown to represent the latitudinal pressure exerted as a result of the relative movement of the shaft. In general terms, the wedge shape of the distal end 2 of the shaft 1 has been used to generate latitudinal pressure as a result of the longitudinal movement of the shaft 1 relative to the expansion sleeve 5 and the handle 9. As shown in FIG. 1, the handle 9 is also prevented from moving relative to the nut 8 because the handle 9 rests on the washer 7 which rests on the nut 8. In an alternate embodiment, the washer 7 is omitted and each of the handle 9, and retention sleeve 6 rest on the nut 8.

Figure 3:
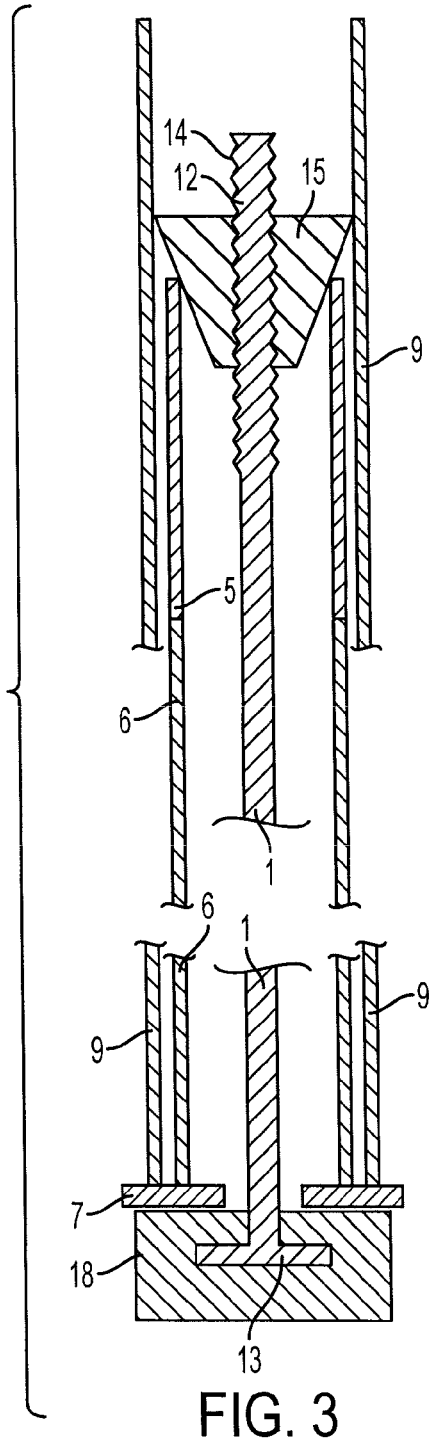
FIGS. 3 and 4 show cross-sectional views of alternate embodiments of a retaining mechanism positioned within a lacrosse stick handle.
Figure 4:
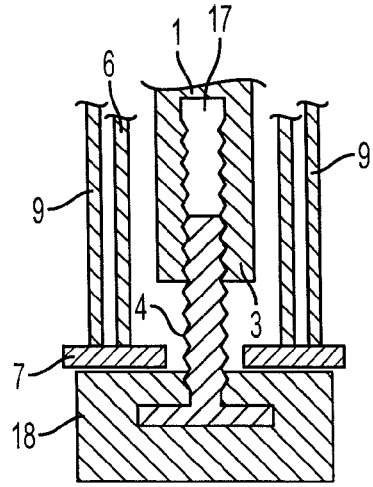

FIGS. 3-4 show alternate embodiments of the head retaining mechanism described above. As described above, in the embodiments shown in FIGS. 3 and 4 the retention mechanism is positioned generally within a hollow handle 9. FIG. 4 shows an embodiment in which the shaft 1 has internal threads instead of external threads on the proximal end 3. In an embodiment having a proximal end constructed as shown in FIG. 4, the distal end 2 is structured the same as and is operated the same as is shown and described with respect to FIGS. 1 and 2. For the embodiment shown in FIG. 4, however, the shaft 1 is moved relative to the sleeves 5 and 6 when knob 18 is rotated in a first direction about the longitudinal axis. With respect to the shaft 1 shown in FIG. 4, the bolt 20 is a complementarily threaded element. A rigid connection between the knob 18 and the threaded bolt 20 results in the bolt 20 turning in the first direction when the knob 18 is turned in the first direction. Thereby, the threads 4 of the bolt 20 engage the internal threads of the shaft 1 and move the shaft relative to the sleeves 5 and 6, the washer 7, and the knob 18. As described above with respect to FIGS. 1 and 2, the relative movement of the shaft 1, which includes the wedge portion on the expanding distal end 2, results in latitudinal pressure against the handle 9 and head 10. While FIG. 3 shows the shaft 1 with relatively small hollow area 17, in alternate embodiments a large portion or essentially the entire shaft 1 is hollow.

In the embodiment shown in FIG. 3, the threads 4 on the shaft 1 are on the distal end 12 thereof. In this embodiment, the knob 18 is rigidly connected to the shaft at the proximal end 13 thereof, such that when the knob 18 is rotated in a first direction about the longitudinal axis, the entire shaft 1 also rotates in the first direction. In this embodiment, a wedge portion 15 is threaded onto the distal end 12 of the shaft 1. As the shaft 1 is rotated in the first direction, the threads 14 on the distal end 12 engage the threads of the wedge 15 such that the wedge 15 moves relative to the shaft 1, the sleeves 5 and 6, the washer 7, and the knob 18, in a direction along the longitudinal axis towards the knob 18. With respect to the shaft 1, the wedge portion is a complementarily threaded element. As described above with respect to FIGS. 1 and 2, as the wedge portion 15, having an expanding radius moves longitudinally toward the proximal end of the shaft 1 relative to the expansion sleeve 5, a latitudinal force is generated on the handle 9 and the head 10.

Figure 5:
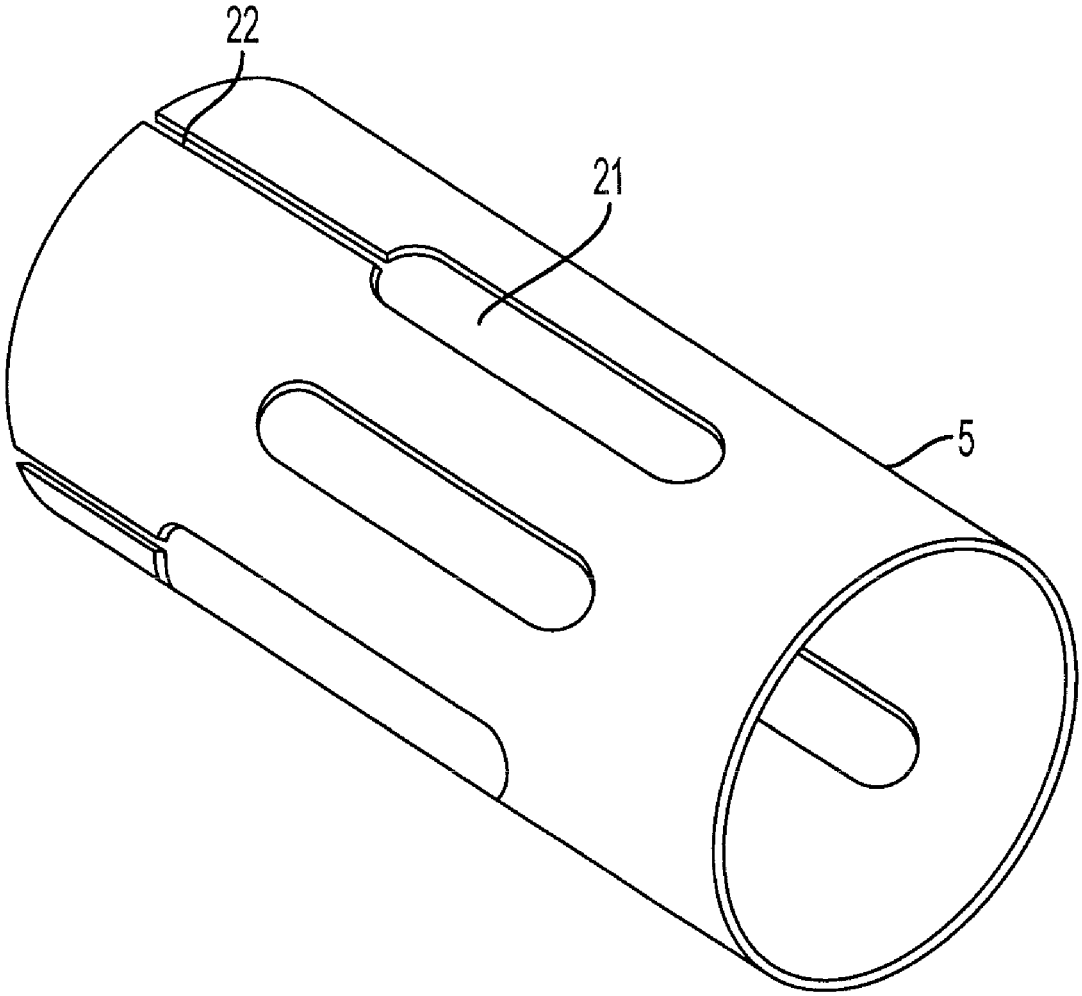
FIG. 5 shows an embodiment of an expansion sleeve for use in an embodiment of a retaining mechanism.

FIG. 5 shows an embodiment of the expansion sleeve 5. In this embodiment, the expansion sleeve 5 is observed to be a hollow cylinder having elongated cut-outs 21 arranged approximately symmetrically about its circumference. Three slits 22 pass through the side of the cylinder, each traversing a longitudinal length from one end of the expansion sleeve 5 to a cut-out 21. In this embodiment, the slits are positioned at every other cut-out. The slits 22 and the cut-outs 21 provide the flexibility necessary for this expansion sleeve 5 to expand latitudinally as describe above. In this embodiment, the generally cylindrical sleeve 5 is fabricated by rolling flat stock. Thus, one of the slits 22 is a product of the creation of the cylinder, and is coextensive with the space between two edges of the stock when rolled into the cylinder that is expansion sleeve 5. In alternate embodiments, the slits and cut-outs have various shapes and sizes and numbers. In an embodiment, the cut-outs are omitted, such that latitudinal expansion is a function of the slits 22 alone. In an embodiment, the cut-outs extend to an end of the expansion sleeve 5, and the slits 22 are omitted therefrom.

In an embodiment, the retention sleeve 6 is simply a hollow cylinder. In an embodiment, the retention sleeve 6 is formed by rolling flat stock into such a cylinder. In an embodiment, there are multiple retention sleeves 6 placed end to end along the length of the shaft 1, instead of a single retention sleeve 6. In an alternate embodiment, the retention sleeve 6 is omitted and the expansion sleeve 5 is used in its place. In such an embodiment, the expansion sleeve 5 traverses essentially the entire distance from one end of the handle 9 to the other, and functions alone as did the combination of expansion sleeve 5 and retention sleeve 6, as described above with respect to the creation of the latitudinal force.

These sleeves need not be cylindrical, but in alternate embodiments are comprised of semi-cylindrical pieces or even one or more rods or pieces otherwise shaped that generally are able to maintain their longitudinal position relative to the handle 9 as the shaft 1 is moved relative thereto. In further alternate embodiments, the function of the expansion sleeve 5 (which may include the role of the retention sleeve as described above with respect to an embodiment wherein the retention sleeve 6 is omitted) is performed by an alternate non-sleeve structure, such as a plate, termed herein a binding plate. In an embodiment, the plate is formed by rolling flat stock, as described above for the expansion sleeve 5, but is formed using stock of half the width such that the binding plate is curved to form a semi-cylindrical structure. A flat binding plate as well as binding plates of various curvature are used in alternate embodiments.

Since an advantage of an expansion sleeve 5 is that its cylindrical structure naturally restrains the expansion sleeve 5 to be adjacent to the shaft 1 positioned through the hollow internal channel thereof, in an embodiment, the binding plate is fabricated to comprise loops generally oriented in an plane that is generally perpendicular to the longitudinal axis of the shaft 1 through which the shaft 1 can be positioned, the effect of which is to restrain the binding plate adjacent to the shaft 1. Other methods of restraining the binding plate should be obvious to one of ordinary skill in the art, including simply restraining the binding plate within the hollow handle.

Additional alternative structures for each element described above with respect to particular embodiments are contemplated hereby and fall within the scope of the invention. For example, in an alternate embodiment the shaft 1 need not be cylindrical and the expanding distal end 2 need not be generally conical, but any shape that provides for the functionality described above may be used, such as a shaft 1 of square cross-section with a pyramidal distal end. Further, the shaft 1 need not be a unitary piece, but may comprise multiple pieces or portions rigidly connected together. For instance, the shaft 1 may have one or more joints between the expanding distal end 2 and the threaded proximal end 3. Also, the retention mechanism, while shown in the FIGS. to extend through most of the length o the handle 9, is significantly shorter in an embodiment, such that the mechanism is positioned primarily near the distal end of the handle 9. In an embodiment having such a construction, movement of the wedge portion is achieved through rotation of the head 10 relative to the handle 9. Moreover, while threads are shown in the FIGS. to cover only a certain length of an element of the mechanism, in alternate embodiments, the threads may cover the entire length of such element, and be either internal or external to that element, with corresponding changes in the complementarily threaded element connected therewith.

Furthermore, additional elements may be present in an embodiment. For instance, in an embodiment, the washer 7 and nut 8, or one of them, may be embedded in, covered by, or co-formed with a handle cap that rests against or fits on or to a proximal end of the handle 9 opposite from the distal end thereof to which the head 10 attaches. Such a handle cap may provide protection to a user or other players from contact with a hard washer 7 or nut 8. Such a handle cap may also provide a grip that facilitates turning of the nut 8 or knob 18, in an embodiment making tightening by hand, even during play, reasonably achievable. In alternate embodiments, such a handle cap functions as the nut 8 or the knob 18. Such a handle cap may be made of any material, but a polymeric material is preferred, including a plastic or an elastomeric material, for instance polyurethane or natural or synthetic rubber. Also, the binding plate or expansion sleeve have one or more latitudinal projections in an embodiment that aid in securing the head to the handle, such as for example, projections that extend through holes in the handle and the head, and thereby resist rotational forces as between the head and handle.

As well, in an embodiment, the retention mechanism, as described above can be utilized with an existing lacrosse stick. That is, a shaft 1 and the other components, such as sleeves 5 and 6, utilized therewith to generate the generally latitudinal force that holds the lacrosse head 10 to the handle 9, can be assembled with a lacrosse stick for which the head and handle were previously assembled with a different mechanism, such as the traditional pin, bolt, or screw through a hole in the head 10 or the handle 9. As such, the retention mechanism can be commercially distributed as a kit for upgrading, repairing, or reconstructing an existing stick. In an embodiment, such a kit is installed in a lacrosse stick without need for additional tools, as is described below with respect to a method of use. Alternately, the retention mechanism is part of a lacrosse stick that has been designed particularly for use therewith.

The mechanism described above can be used in a method to hold a head 10 in place on a hollow handle 9. With respect to such a method the mechanism is generally referred to as a retention mechanism or a head retention mechanism. An embodiment of such a method includes assembling the retention mechanism, including the nut 8, washer 7, shaft 1, and sleeves 5 and 6 as shown in FIG. 1, inserting the retention mechanism into a hollow handle 9, positioning the handle 9 into the socket of a head 10, and turning the nut 8 in a first direction to create a latitudinal pressure from within the handle 9 against the head 10 as described above, thereby retaining the head 10 on the handle 9. A further embodiment of such a method includes further rotation of the nut 8 in order to increase the latitudinal pressure applied from the handle 9 against the head 10. In an embodiment such further rotation may be performed while on the field during play of the game without interrupting play, and facilitates the maintenance of a rigid joint between head 10 and handle 9, which is desired by many players. In yet another embodiment, the nut is rotated in a second, generally opposite, direction, allowing the pressure between the head 10 and the handle 9 to be reduced, thereby facilitating removal of the handle 9 from the head 10. It should be obvious to one of ordinary skill in the art that these methods can be easily adapted to be performed with alternate embodiments of the retention mechanism and stick as described above. For instance, rather than turning the nut 8, in an alternate embodiment, the knob 18 is turned.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A lacrosse stick comprising:

a hollow handle having a proximal end and a distal end;

a head with an extension that forms a joint with said distal end of said handle; and a retention mechanism that is separable from both said handle and said head, that is positioned generally within said hollow handle, said retention mechanism comprising:

an expansion sleeve;

a shaft having a proximal end and a distal end and a length therebetween, said shaft extending through said expansion sleeve;

a wedge portion positioned at said distal end of said shaft, said wedge portion being moveable relative to said expansion sleeve in a longitudinal direction; and a means for moving said wedge portion longitudinally relative to said expansion sleeve;

wherein when said wedge portion is moved longitudinally, said wedge causes a latitudinal expansion of said expansion sleeve and said hollow handle; and said retention mechanism further comprising a retention sleeve, said shaft also extending through said retention sleeve and wherein said wedge is attached toward said distal end of said shaft and said expansion sleeve is closer to said distal end of said shaft than said retention sleeve.

2. The lacrosse stick of claim 1 wherein said shaft and said wedge portion are fabricated as one piece, said wedge portion being an integral part of said distal end of said shaft.

3. The lacrosse stick of claim 1 wherein said retention mechanism further comprises:

a washer through which passes said proximal end of said shaft, said washer sized to provide a surface on which rests an edge of said expansion sleeve.

4. The lacrosse stick of claim 1 wherein said means for moving comprises threads cut into a portion of said shaft.

5. The lacrosse stick of claim 4 wherein said retention mechanism further comprises a complementarily threaded element; and wherein said threads of said shaft are provided on said proximal end of said shaft and are engaged by said complementarily threaded element, such that rotation of said complementarily threaded element in a first direction moves said shaft in a longitudinal direction relative to said complementarily threaded element toward said complementarily threaded element.

6. The lacrosse stick of claim 1 wherein said distal end of said shaft is provided with threads; and wherein said wedge portion is threaded onto said distal end.

7. The lacrosse stick of claim 1 wherein said expansion sleeve comprises a hollow cylinder.

8. The lacrosse stick of claim 7 wherein said expansion sleeve includes a plurality of elongated cut-outs.

9. The lacrosse stick of claim 8 wherein said elongated cut-outs are arranged approximately symmetrically about the circumference of said expansion sleeve.

* * * * *